United States Patent [19]

Avey

[11] Patent Number: 5,062,163

[45] Date of Patent: Nov. 5, 1991

[54] HEAD PROTECTOR FOR USE WITH HARD HEAD GEAR

[76] Inventor: I. D. Jean Avey, Rt. 1, Box 90, Albert, Kans. 67511

[21] Appl. No.: 25,638

[22] Filed: Mar. 13, 1987

[51] Int. Cl.[5] ..... A42B 3/00

[52] U.S. Cl. ..... 2/424; 2/410; 2/423

[58] Field of Search ..... 2/4, 6, 172, 205, 410, 2/422, 423, 424

[56] References Cited

U.S. PATENT DOCUMENTS

| | | | |
|---|---|---|---|
| 1,164,351 | 12/1915 | Hulstrom | 2/4 |
| 3,146,462 | 9/1964 | Militello | 2/410 |
| 3,582,990 | 6/1971 | Frieder | 2/6 |
| 4,091,469 | 5/1978 | Davidson | 2/410 |
| 4,180,868 | 1/1980 | Snow | 2/172 X |
| 4,547,908 | 10/1985 | Karlsson et al. | 2/424 |
| 4,573,217 | 3/1986 | Reed | 2/205 X |
| 4,593,417 | 6/1986 | Brown et al. | 2/205 X |
| 4,602,385 | 7/1986 | Warren | 2/410 X |

*Primary Examiner*—Werner H. Schroeder
*Assistant Examiner*—John J. Calvert
*Attorney, Agent, or Firm*—Phillip A. Rein

[57] ABSTRACT

This structure includes a head protection assembly to be attached to a hard hat structure including a brim support section mounted about a tapered brim section of the hard hat structure; a mid-body cover section integral with the brim support section; a chin protection and anchor assembly integral with a lower portion of the mid-body cover section; and a nose and cheek cover attachment which can be readily attached to the mid-body cover section. The chin protection and anchor assembly and the nose and cheek cover attachment are provided with readily adjustable connector and anchor assemblies to achieve the maximum fit about a person's head utilizing this invention. Another embodiment is a similar head protection assembly connected to the hard hat structure constructed of a spaceage sunscreen material for summertime usage. A third embodiment is a cap head protection assembly which can be readily attached to a baseball type cap member or other head protection covers through use of a cap connector assembly. The summer cap head protection assemblies are provided with the connector and anchor assemblies to achieve maximum adjustment features.

4 Claims, 2 Drawing Sheets

FIG. 1
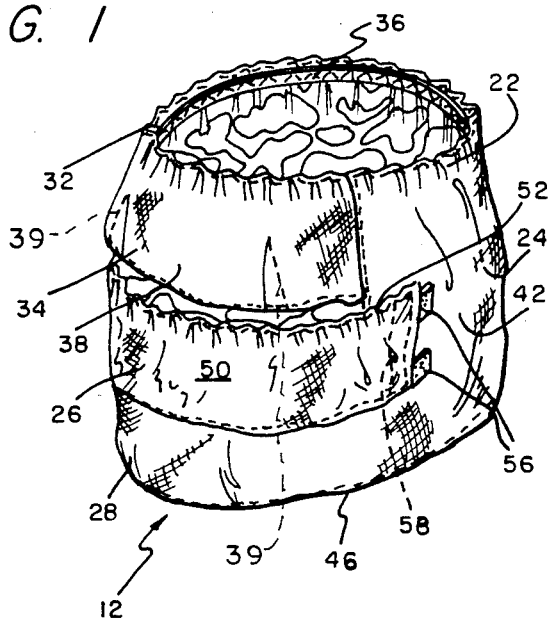
FIG. 2
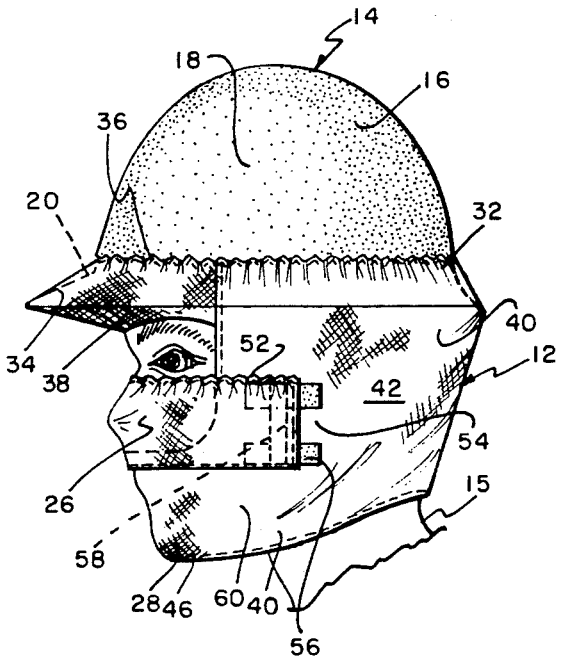
FIG. 3
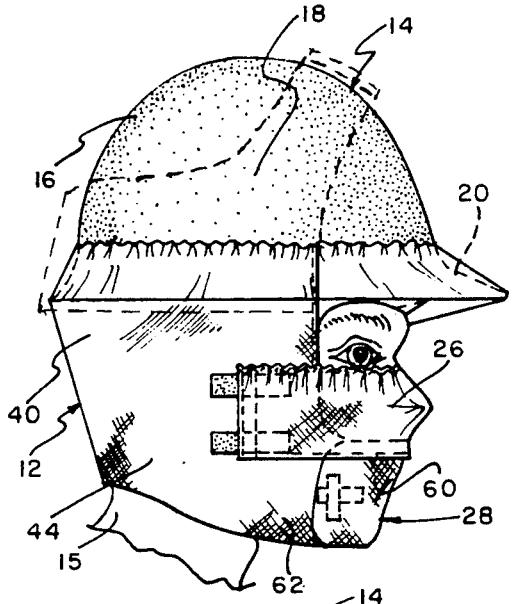
FIG. 4
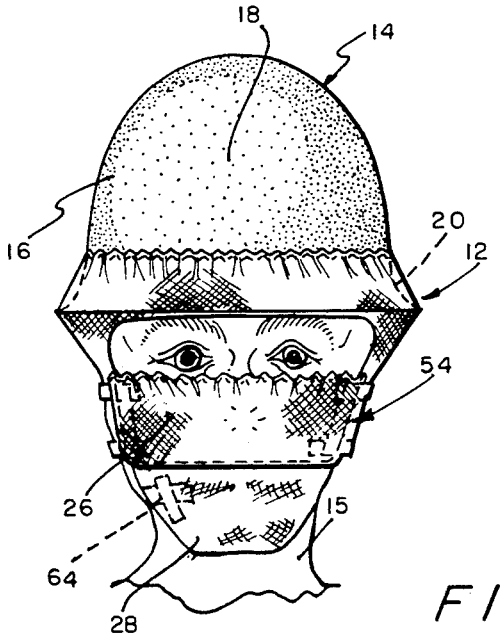
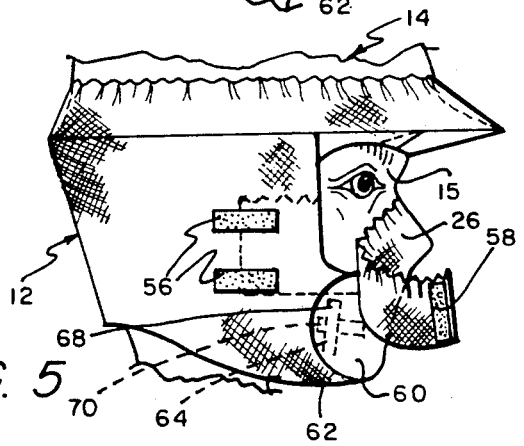
FIG. 5

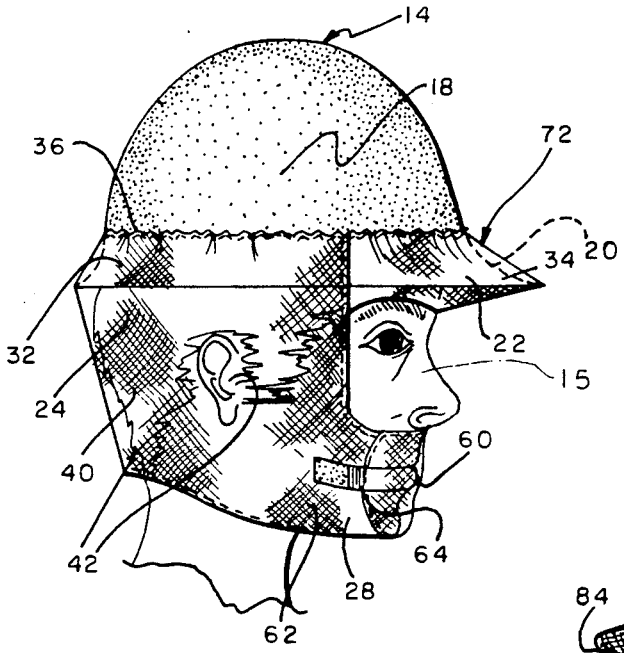
FIG. 6
FIG. 7
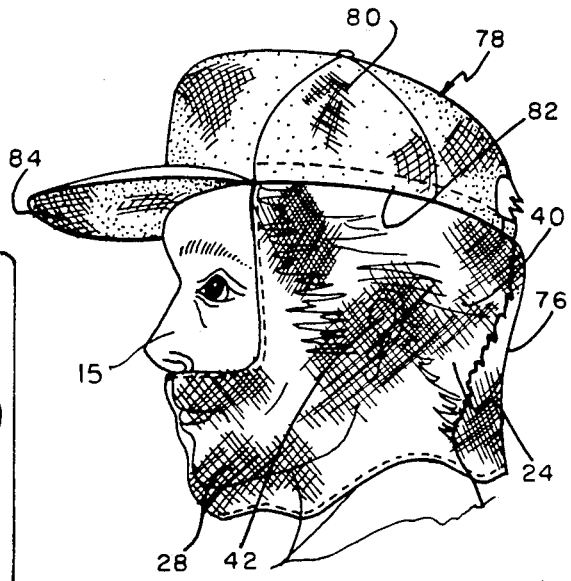
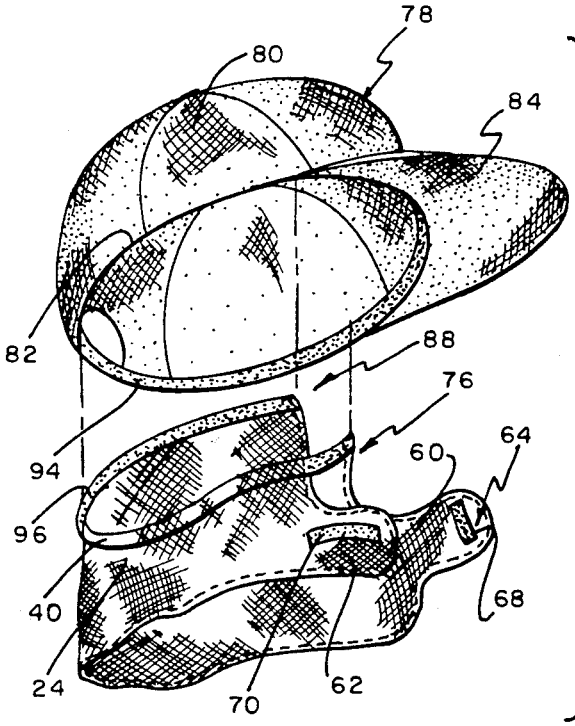
FIG. 8
FIG. 9
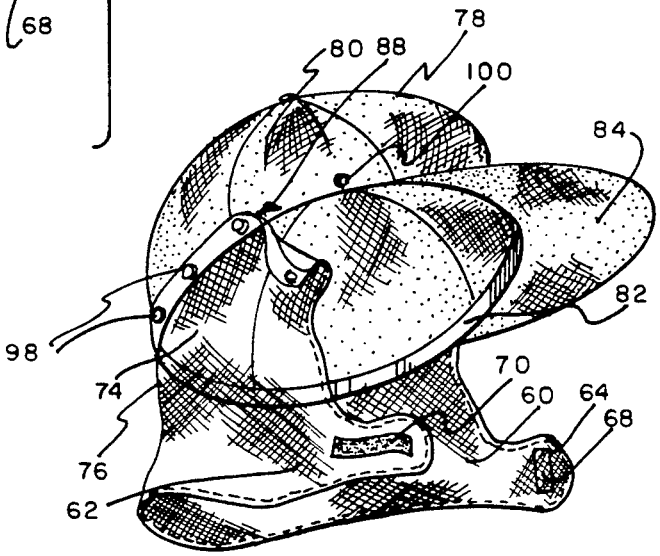

HEAD PROTECTOR FOR USE WITH HARD HEAD GEAR

PRIOR ART

The following known U.S. Pat. Nos. relating to attachment structures connectable to hard hat structures are noted:

| Reg. No. | Patent | Inventor |
|---|---|---|
| 1,655,007 | HEADGEAR | Boettge |
| 3,100,896 | HOOD OVER-All | Khanbegian |
| 3,146,462 | COLD WEATHER ATTACHMENT FOR HARD HEAD GEAR | Militello |
| 3,205,508 | SAFETY HELMET LINER AND ASSEMBLY | Cox |
| 3,594,814 | SAFETY HAT LINER AND ASSEMBLY | Schuessler et al |
| 4,091,469 | HEAD PROTECTOR FOR USE WITH HARD HEAD GEAR | Davidson |

The Davidson patent discloses a head protector for use with hard head gear similar to our invention having similar features but does not have a nose and cheek cover attachment or a chin protector and anchor section similar to the applicant's invention as claimed herein.

The Schuessler et al patent discloses a safety hat liner assembly which is fitted on the inside of a hard hat structure but the structure alters the safety features of the hard hat and not permissible under today's governmental regulations. Schuessler et al discloses a cover structure as shown in FIG. 3 to shield the wearer thereof from the cold weather.

The Cox patent discloses a safety helmet liner assembly illustrating a helmet structure in FIG. 4 which is connected to the interior of a hard hat structure.

The Khanbegian patent discloses a hood over-all which is connected to a hard hat structure for the protection of one's head and neck area but does not disclose numerous features of the applicant's invention.

The Boettge patent discloses a headgear having a head coverage structure similar to a hood member.

It is submitted that the applicant's invention sets forth new structure features which are not shown by the United States patents described herein above.

PREFERRED EMBODIMENT OF THE INVENTION

In one preferred embodiment of this invention, a head protection assembly mountable on construction hard hat structures, provides additional protection to the neck and head area of the user thereof from inclement weather and wind associated therewith. The head protection assembly includes a 1) brim support section; 2) a mid-body cover section integral with the brim support section; 3) a nose and cheek cover attachment which is releasably connectable to the mid-body cover section; and 4) a chin protector and anchor assembly integral with a lower portion of the mid-body cover section. The chin protector and anchor assembly is operable to cover the neck and chin portion of the person utilizing the head protection assembly of this invention.

The brim support section is provided with a top portion having a brim portion connected thereto so as to fit in an elastic, clamping type action about a brim section of the hard hat structure to hold the same firmly thereabout. The brim portion is provided with an elastic brim band member which is adapted to fit around and against the brim section of the hard hat structure plus seal against the forehead of the person wearing same.

The mid-body cover section is provided with a main head cover section integral with ear cover sections and having an integral neck band member connected thereto. The mid-body cover section includes a front cut-out section to provide unobstructed view by the person wearing same. The chin protector and anchor section is provided with a left flap cover member and a right flap cover member which are downwardly depending to provide sufficient protection against the weather to the chin area of the user thereof. Each of the left or right flap cover members are provided with anchor strips being Velcro members to easily interconnect same plus being readily adjustable to the size of the wearer thereof.

The nose and cheek cover attachment includes a main body section having an elastic top band member across the upper edge and an anchor assembly secured to outer edges thereof. The anchor assembly includes cover connector members releasably engagable with base members on the ear cover sections of the mid-body cover section. The nose and cheek cover attachment is operable to be adjustably connected to the mid-body cover section to provide a shield to the wearer's nose and mouth area from inclement weather conditions.

In another preferred embodiment of this invention, a head protection assembly is provided being attachable to a hard hat structure having similar features as the first embodiment but constructed of a sunscreen material so as to shield the sun rays from the wearer thereof while permitting the flow of air particles therethrough.

In one other embodiment of this invention, a cap head protection assembly is operable to be attached to a baseball cap type structure and having a cap connector assembly. The cap connector assembly includes two (2) embodiments 1) being a Velcro connector assembly and 2) a snap connector assembly. The Velcro connector assembly is provided with Velcro members which are attached to 1) a lower peripheral portion of the baseball cap structure and 2) an upper peripheral portion of the mid-body cover section so as to be releasably connected to each other. The snap connector assembly is provided with a plurality of male and female snap members having the female snap members connected to an outer lower periphery of the baseball cap member and the male snap members secured to an upper pheripheral portion of the mid-body cover section so as to be readily connected to each other as so desired.

OBJECTS OF THE INVENTION

One object of this invention is to provide a head protection assembly which is readily connectable to a construction type hard hat structure to provide the maximum protection from inclement weather conditions to the person using same.

One other object of this invention is to provide a head protection assembly readily connectable to a hard hat structure having an elastic brim support section connected to the brim portion of the hard hat structure; a mid-body cover section to provide covering to the user's head portion while having an opening for easy visual and breathing purposes; and a chin protector and anchor assembly integral with the mid-body cover section having a connector assembly to readily connect left and right flap cover members in a secure manner to protect the user's cheek and neck area.

Still, one other object of this invention is to provide a head protection assembly for use with a construction type hard hat structures including a mid-body cover section integral with a chin protector and anchor assembly and having a removable nose and cheek cover attachment which can be connected to the mid-body cover section to cover the wearer's nose and mouth areas while leaving an open area for visual observation thereto.

Another object of this invention in a second embodiment is to provide a summer head protection assembly for use on a hard hat structure which has an elastic brim support section with the other portions constructed of a sunscreen material which filters out the sun rays while allowing the air particles to flow therethrough for use in summertime weather conditions.

One further object of this invention in another embodiment is to provide a cap head protection assembly which is utilized with a baseball cap type member having a mid-body cover section and a chin protector and anchor section constructed of the sunscreen material and having a cap connector assembly for attachment to the baseball cap member.

Various other objects, advantages, and features of this invention will become apparent to those skilled in the art from the following discussion, taken in conjunction with the accompanying drawings, in which:

FIGURES OF THE INVENTION

FIG. 1 is a perspective view of a head protection assembly of this invention;

FIG. 2 is a side elevational view thereof as worn on a hard hat structure supported on a person's head;

FIG. 3 is a view similar to FIG. 2 showing the opposite side thereof;

FIG. 4 is a front elevational view of the head protection assembly on a hard hat structure worn on a person's head;

FIG. 5 is a fragmentary side elevational view similar to FIG. 3 illustrating movement of a face protector cover to an enclosed condition;

FIG. 6 is a side elevational view of a second embodiment being a summer head protection assembly constructed of a sunscreen material and worn on a hard hat structure supported on a person's head;

FIG. 7 is a side elevational view of a cap head protector assembly being a third embodiment as attached to a baseball cap member;

FIG. 8 is an exploded perspective view of the third embodiment of the cap head protector assembly illustrating attachment connection as by Velcro members to the baseball cap member; and FIG. 9 is a perspective view of the third embodiment and showing attachment to the baseball cap member thru the use of a snap connector assembly.

The following is a discussion and description of preferred specific embodiments of the head protection assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

On referring to the drawings in detail and in particular FIG. 1, a head protection assembly of this invention, indicated generally at 12, is utilized to be mounted on construction type hard hat structures 14 which are known to be loose fitting for support and safety purposes and, therefore, provide little weather protection to the head area of the person wearing same which problem is to be overcome by the invention herein.

The hard hat structure 14 includes a rigid hat assembly 16 having a head support assembly mounted on the interior thereof. The rigid hat assembly 16 includes a curved upper domed section 18 integral with an outwardly tapered brim section 20. The rigid hard hat assembly 18 is constructed of a heavy metal or modern plastic material which provides safety to the wearer thereon on being hit by falling objects such as a hammer or the like during building construction environment.

The head support assembly (not shown) is of a conventional nature being provided with an adjustable dome and band assembly so as to be supported on the person's head utilizing the hard hat structure 14 to provide spacing therefrom and, thus, a shock absorbing feature.

The head protector assembly 12 includes 1) a brim support section 22 adapted to be mounted about the tapered brim section 20 of the rigid hat assembly 16; 2) a mid-body cover section 24 integral with the brim support section 22; 3) a chin protection and anchor section 28 which is integral with a lower portion of the mid-body cover section 24; and 4) a nose and cheek cover attachment 26 which is releasably connected to a portion of the mid-body cover section 24 and adapted to protect the wearer's nose and cheek areas as will be explained.

The brim support section 22 includes a top portion 32 integral with a brim portion 34. The top portion 32 has an upper elastic band member 36 thereabout to firmly fit against a portion of the domed section 18 of the rigid hat assembly 16.

The brim portion 34 includes an elastic brim band member 38 which is adapted to be received in a clamping type manner as illustrated in FIG. 2 and, additionally, to elastically clamp against the forehead of the person wearing same.

A forward portion of the elastic brim band member 38 is provided with a pair of spaced tuck portions 39 which are found to be important to the proper fitting of the head protection assembly 12 of this invention about the hard hat structure 14.

The mid-body cover section 24 includes a main head cover section 40 integral with ear cover sections 42, all constructed of a weather and windproof material. The main head section 40 is provided with a neck portion 44 and having integral therewith a neck band member 46 to protect the wearer's neck portion.

The ear cover sections 42 are operable to cover the wearer's ears and provide substantial protection from the inclement weather.

The chin protector and anchor sections 28 includes a left flap cover member 60 and a right flap cover member 62 which are integral with adjacent portions of the mid-body cover section 24 and having a connector assembly 64 to releasably connect the left and right flap cover members 60, 62.

The left and right flap cover members 60, 62 are constructed of the similar weather and windproof material as the mid-body cover section 24 and each are downwardly depending so as to enclose and cover the wearer's mouth and chin portion as noted in FIG. 5.

The connector assembly 64 includes a first anchor strap member 68 and a second anchor strap member 70 which are adapted to be releasably connectable to each other. The first anchor strap member 68 is mounted on the left flap cover member 60 and is perpendicular to the longitudinal axis of the left flap cover member 60 as noted in FIGS. 3, 4, and 5.

The second anchor strap member 70 is mounted on the right flap cover member 62 and being parallel to the longitudinal axis thereof. The first and second anchor strap members 68, 70 are preferably constructed of a Velcro type fastener with the perpendicular arrangement to each other for achieving various amounts of adjustments of the connector assembly 64 which is very desirable as will be explained in detail.

As best noted in FIG. 1, the nose and cheek cover attachment 26 includes 1) a main body section 50; 2) an elastic top band member 52; and 3) an anchor connector assembly 54. The main body section 50 is constructed of the weather and windproof type material and maybe of an elastic nature so as to provide a close fit over the wearer's nose as noted in FIGS. 2 and 3. It is obvious that these weather and windproof type materials can be of various modern materials achieving protection against cold weather while maintaining the heat generated from one's own body therein.

The top band member 52 is an elastic material to provide the ultimate in protection about the one's upper nose portion and adjacent cheek portions as shown in FIG. 2.

The anchor connector assembly 54 is provided with base members 56 connected to a portion of the mid-body cover section 24 on opposed sides thereof and having a cover connector means 58 mounted on the outer edges of the main body section 50. The base members 56 are as shown having a pair thereof mounted on each side adjacent to the ear cover sections 42 and parallel to the top peripheral edge of the brim support section 22.

The cover connector members 58 are mounted on the outer edges of the main body section 50 and are extended in a vertical direction. The base members 56 and the cover connector members 58 are preferrably constructed of a Velcro fastener material and, therefore, allows for the ready adjustment of the nose and cheek cover attachment 26 about the wearer's face portion to provide the ultimate in protection against inclement weather as will be explained.

A second embodiment of this invention noted in FIG. 6 includes a summer head protection assembly 72 utilized for warm weather conditions utilizing a new and novel spaceage sunscreen material to filter out the sun's rays while allowing air low therethrough. The summer head protection assembly 72 is adapted to be mounted about the previously described hard hat structure 14.

The summer head protection assembly 72 includes 1) the brim support section 22; 2) the mid-body cover section 24 integral with a lower portion of the brim support section 22; and 3) the chin protection and anchor assembly 28 integral with a lower portion of the mid-body cover section 24.

The chin protector and anchor assembly 28 of the summer hat protection assembly 22 has the previously described connector assembly 64 with the first and second anchor strap members 68, 70 to provide for the interconnection thereof as noted in FIG. 6.

Additionally, the anchoring proceedure of the brim support section 22 of the summer head protection assembly 72 to the hard hat structure 14 is similar to that previously described while utilizing the spaceage sunscreen material so as to provide protection from the wind and sun rays during summer usage thereof.

As noted in FIGS. 7 and 8, a third embodiment of this invention is illustrated as having a cap head protection assembly 76 which is adapted to be connected to a conventional baseball type cap member 78 of a conventional nature. The baseball cap member 78 includes a domed head section 80 having a lower peripheral band 82 and a forwardly projected brim member 84 integral with the head section 80.

The cap head protection assembly 76 includes the previously described mid-body cover section 24 and chin protection and anchor section 28 but having a cap connector assembly 88 thereon adapted to be connected to a portion of the peripheral band 82 of the baseball cap 78.

The mid-body cover section 24 and the chin protection and anchor assembly 28 may be constructed of the weather and windproof type material for use during cold weather situations or of the sunscreen material to provide for the filtering of the sun rays and allowing for air flow therethrough.

The cap connector assembly 88 has two embodiments being 1) a Velcro connector assembly or 2) a snap connector assembly.

The Velcro connector assembly is provided with 1) a first connector section 94 secured to an inner peripheral surface of the peripheral band 82 on the baseball cap 78; and 2) a second connector section 96 secured to an upper peripheral surface exterior edge of the mid-body cover section 24. This is clearly shown in FIG. 8 in the exploded perspective view. It is obvious that the first and second connector sections 94, 96 can be attached to each other by the Velcro material to present the assembled condition as shown in FIG. 7. The use of the Velcro connector assembly allows the user thereof to wear the baseball cap member 78 in a conventional manner and use the cap head protection assembly 76 as desired as it can be readily attached and removed.

As noted in FIG. 9, the snap connector assembly includes a plurality of male snap members 98 connected to an upper peripheral portion of the mid-body cover section 24 and a plurality of female snap members 100 connected to the outer peripheral surface of the band 82 of the baseball cap member 78. The male snap members 98 and female snap members 100 are spaced equal distance from each other for interconnection to the baseball cap member 78 as noted in FIG. 9. This allows for the easy attachment and removal of the cap head protection assembly 76 from the baseball cap member 78 depending on weather conditions.

The head protection assemblies of this invention are easy to mount on hard hat structures or baseball cap type structures being easy to use; economical to manufacture; substantially maintenance free; and having features for the protection of the head, neck, and face areas of the wearer from either inclement or summertime weather conditions.

USE AND OPERATION OF THE INVENTION

In the use and operation of the head protection assembly 12 of this invention, FIG. 1 illustrates the unmounted condition which is operable to be placed on the hard hat structure 14. As noted in FIG. 2, the brim support section 22 of the head protection assembly 12 is initially pulled downwardly over the domed section 18 of the hard hat structure 14. The elastic band member 36 of the top portion 32 and the brim portion 34 are operable to achieve a clamped relationship about the tapered brim section 20 and domed section 18 of the hard hat structure 14 due to the elastic nature of the brim portion 34. This provides a clamping action thereto to maintain the entire head protection assembly 12 mounted on the hard hat structure 14.

Next, it is seen that the hard hat structure 14 is placed on a head portion of the person 15 to wear same as noted in FIGS. 2 and 4. It is seen that the mid-body cover section 24 utilizes the main head cover section 40 to cover a major portion of the head and neck portion of the wearer thereof. The ear cover sections 42 enclose the ears of the wearer thereof.

As noted in FIG. 3, the chin protector and anchor section 28 is operable through the left and right flap cover members 60, 62 to be pulled outwardly to cover the wearer's chin area with the left flap cover member 60 overlapping the right flap cover member 62. The connector assembly 64 thereupon operates with the first and second anchor strap members 68, 70 which are preferably constructed of a Velcro material to achieve the attached condition. Depending on the weather conditions, the user of the head protection assembly 12 of this invention can utilize the nose and cheek cover attachment 26 to cover the nose, cheek, and upper lip portions as shown in FIGS. 2, 3, and 4.

As noted in FIG. 5, the nose and cheek cover attachment 26 has one portion of the anchor connector assembly 54 with the base members 56, 58 connected to one side thereof being the left side. The main body section 50 with the one side anchored is pulled across the person's nose, upper lip and cheek portions for ready attachment of the base members 56 and the cover connector member 58 on the right side of the mid-body cover section 24. Due to the perpendicular relationship of the base members 56 to the cover connector members 58, it is obvious that the main body section 50 can be pulled tightly across a nose portion of the person 15 wearing same. Also, the upper elastic top band member 52 provides a seal across the bridge of the nose portion and underneath the eye portions of the person 15. This provides maximum protection as the only exposed portion of the person 15 is the lower forehead and the eye areas as noted in FIG. 4.

The embodiment of the head protection assembly 12 is constructed of an elastic band material for attaching to the hard hat structure 14 and, additionally, constructed of a spaceage weather protection material to achieve the ultimate in inclement weather protection. The novel features of the invention include the means of interconnecting the left flap cover member 60 to the right flap cover member 62 by the connector assembly 64 with the Velcro connectors. Another novel feature is the use of the nose and cheek cover attachment 26 with its anchor connector assembly 54 using Velcro members to provide the ease of connection and adjustability to provide portection from the inclement weather.

In the use and operation of the second embodiment of this invention, the summer head protection assembly 72 noted in FIGS. 6 and 7 is mounted on a hard hat structure 14. The brim support section 22 is mounted about the tapered brim 20 of the hard hat structure 14 as previously described for the head protection assembly 12. Additionally the interconnection of the chin protector and anchor assembly 28 is in a manner similar to that described in the first embodiment and as shown in FIG. 6.

The brim support section 22 utilizes the same brim portion 34 having an elastic brim band member 38 which holds the summer head protection assembly 72 securely on the hard hat structure 14.

The primary difference between the summer head protection assembly 72 from the head protection assembly 12 is that the first is constructed of a spaceage sunscreen type material which filters out the sun rays while allowing air particles to move therethrough for a cooling effect.

In the third embodiment of this invention as shown in FIGS. 7, 8, and 9, the cap head protection assembly 76 is mountable in two embodiments to the lower periphery of a baseball cap member 78. FIGS. 7 and 8 illustrate one embodiment using the cap connector assembly 88 having a Velcro connector assembly. On use of the Velcro connector assembly, the first connector section 94 is a Velcro band mounted on the inner lower periphery of the head section 80 of the baseball cap member 78. The second connector section 96 is secured to the outer surface of an upper peripherial portion of the mid-body cover section 24. As noted in FIG. 8 in the exploded perspective view, the mid-body cover section 24 is interconnected to the baseball cap member 78 by mating of the Velcro connector assembly to achieve the usage condition of FIG. 7.

The second embodiment of the cap connector assembly 88 is the snap connector assembly as shown in FIG. 9. The snap connector assembly includes the female snap members 100 secured to an outer peripheral portion of the head section of the baseball cap member 78. Furthermore, the snap connector assembly includes the male snap members 98 which are connected to an upper periphery of the mid-body cover section 24 of the cap head protection assembly 76. It is obvious that the equally spaced male and female snap members 98, 100 are interconnected to each other to provide a means for attachment to the baseball cap member 78 as noted in FIG. 9.

Although the cap head protection assembly 76 in FIGS. 7–9, inclusive, are illustrated as constructed of a spaceage sunscreen material for use in protection against the wind and sun rays, it is obvious that it could also be constructed of an inclement weather protective material as previously described for the head protection assembly 12.

As noted in dotted lines in FIG. 3, the head protection assembly 12 can be moved to a folded or flap storage position when changes in weather conditions occurs. It may be windy and cold when the head protection assembly 12 is first used but warmer in the afternoon wherein the left and right flap cover members 60, 62 are folded upwardly and the end portions interconnected by the first and second strap members 68, 70.

In the flap folded condition, it is seen that the main head cover section 40 of the mid-body cover section 24 is concurrently folded upwardly to reveal the person's neck and ear portions if desirable due to weather conditions.

It is obvious that the summer heat protection assembly 72 and the cap head protection assembly 76 can have their respective mid-body cover sections 24 and the chin protection and anchor sections 28 moved to the folded or flap storage position of FIG. 3 if deemed desirable.

Additionally, the baseball cap member 78 could be a fur cap or the like utilizing the cap connector assembly 88 of this invention for attachment of the cap head protection assembly thereto.

An important feature of this invention is provided by the tuck portion in the brim support section to provide for a secure attachment to the hard hat structure and against the forehead area of the wearer thereof plus the use of the removable and adjustable nose and cheek cover attachment. Additionally, the means of connecting the chin protector and anchor assembly in a readily adjustable manner to achieve the utmost protection to the wearer about the neck and head areas is another important feature.

It is seen that the head protection assemblies, as described in the embodiments of this invention, are readily attachable to various types of head gear in a secure and releasable fashion while providing a maximum of protection to the person wearing same. The head protection assemblies are readily mounted on hard hat structures, baseball cap members, or other types head protection covers.

While the invention has been described in conjunction with preferred specific embodiments thereof, it is to be understood that this description is intended to illustrate and not to limit the scope of the invention, which is defined by the following claims.

I claim:

1. A head protection assembly adapted to be connected about a tapered brim section of a hard hat structure to be worn on the head of a person, comprising:

a) a brim support section mountable in a resilent manner about the tapered brim section of a hard hat structure b) a mid-body cover section integral with a lower portion of said brim support section to cover head and ear portions of the person utilizing same;

c) a chin protector and anchor assembly integral with a lower portion of said mid-body cover section;

d) said chin protector and anchor assembly including a left flap cover member and a right flap cover member downwardly depending from said mid-body cover section; each of said left flap cover member and said right flap cover member of substantial width operable to engage and cover chin and mouth portions of the person wearing same;

e) said chin protector and anchor assembly having a connector assembly to adjustably connect a lower portion of said left flap cover member to said right flap cover member to fit in a weather sealing and enclosed condition about the chin portion of the person wearing same; and f) said brim support section including a brim portion constructed of an elastic material having a pair of tuck portions therein to provide the necessary clamping action about the tapered brim section of the hard hat structure operable to elastically clamp against a forehead portion of the person wearing same.

2. A head protection assembly as described in claim 1, wherein:

a) said connector assembly of said chin protector and anchor section having a first anchor strap member connected to said left flap cover member, and a second anchor strap member connected to said right flap cover member; and b) said first and second anchor strap members constructed of a Velcro material and positioned perpendicular to each other in the usage condition to allow a maximum adjustment of said chin protector and anchor assembly.

3. A head protection assembly as described in claim 2, wherein:

a) said first anchor strap member extended perpendicular to a longitudinal axis of said left flap cover member; and b) said second anchor strap member parallel to the longitudinal axis of said right flap cover member;

whereby the interconnection of said first anchor strap member to said second anchor strap member provides for an adjustable feature only limited by the length of said second anchor strap member and is operable to provide both vertical and horizontal adjustments as so desired by the wearer thereof to provide a weather sealing and enclosed condition about the chin and mouth portions.

4. A head protection assembly as described in claim 1, includes:

a) a nose and cheek cover attachment which is selectively mountable between opposing portions of said mid-body cover sections to provide protection to a face portion of the wearer thereof;

b) said nose and cheek cover attachment including a main body section and having an anchor connector assembly connected to outer ends thereof; and c) said anchor connector assembly includes base members secured to opposed portions of said mid-body cover section and cover connector members connected to outer ends of said main body section of said nose and cheek cover attachment to provide for vertical and horizontal adjustment connection of said nose and cheek cover attachment to said mid-body cover section.

* * * * *